US008736168B2

(12) United States Patent
Sasai

(10) Patent No.: US 8,736,168 B2
(45) Date of Patent: May 27, 2014

(54) CERAMIC METAL HALIDE LAMP

(71) Applicant: Yasushi Sasai, Gyoda (JP)

(72) Inventor: Yasushi Sasai, Gyoda (JP)

(73) Assignee: Iwasaki Electric Co., Ltd. (JP)

( * ) Notice: Subject to any disclaimer, the term of this patent is extended or adjusted under 35 U.S.C. 154(b) by 54 days.

(21) Appl. No.: 13/760,799

(22) Filed: Feb. 6, 2013

(65) Prior Publication Data

US 2013/0200787 A1 Aug. 8, 2013

(30) Foreign Application Priority Data

Feb. 8, 2012 (JP) ..... 2012-025594

(51) Int. Cl.
*H01J 17/20* (2012.01)

(52) U.S. Cl.
USPC ..... 313/640; 313/637

(58) Field of Classification Search
USPC ..... 313/25–27, 111–117, 317, 313/318.01–318.09, 483–493, 567–577, 313/623, 627–643; 445/26
See application file for complete search history.

*Primary Examiner* — Donald Raleigh
(74) *Attorney, Agent, or Firm* — Lerner, David, Littenberg, Krumholz & Mentlik, LLP

(57) ABSTRACT

A ceramic metal halide lamp is provided in which color rendering properties, especially a special color rendering index R9, are improved without causing lamp efficiency to be lowered substantially. In one aspect, a ceramic metal halide lamp includes a luminous tube in the interior of an outer bulb. The luminous tube is made from translucent ceramics and includes a light-emitting portion into which metal halides, mercury and a starting gas are sealed and capillaries with a pair of electrode assemblies extended thereto disposed at both ends of the light-emitting portion. The light-emitting portion has sealed therein at least thulium iodide ($TmI_3$), thallium iodide (TlI), sodium iodide (NaI) and calcium iodide ($CaI_2$). The light-emitting portion has further sealed therein silver iodide (AgI). A quantity of the AgI falls within a range of $2 \leq (AgI/CaI_2)$[molar ratio]$\leq 5$ and within a range of $0 < (AgI/TlI)$[molar ratio]$\leq 10$.

8 Claims, 3 Drawing Sheets

COMPARISON OF SPECTRAL DISTRIBUTION

CERAMIC METAL HALIDE LAMP

CROSS REFERENCE TO RELATED APPLICATIONS

The present application claims the benefit of and priority to JP Application No. 2012-025594, filed Feb. 8, 2012, the entire disclosure of which is incorporated by reference herein.

BACKGROUND OF THE INVENTION

1. Field of the Invention

The present invention relates to a ceramic metal halide lamp.

2. Description of Related Art

As a high-intensity discharge lamp (HID lamp), there exist, for example, a high-pressure mercury lamp, a high-pressure sodium lamp, a metal halide lamp and a ceramic metal halide lamp. The HID lamp is able to produce light by effectively utilizing discharges occurred between electrodes. Therefore, as compared with incandescent electric lamps, the HID lamp has various characteristics such as being large in luminous flux so as to become suitable for use in illumination of a large-scale area and being excellent in energy efficiency.

As to the HID lamp, in 1960s, there have been developed metal halide lamps using metal halide in which color rendering properties and luminous efficiency could be improved as compared with fluorescent mercury lamps.

In the metal halide lamp, since a luminous tube (arc tube) is made of a ceramic material and such ceramic material rarely reacts with the materials sealed into the inside of the luminous tube as compared with a prior-art luminous tube made of quartz, such metal halide lamp is able to use a wide variety of luminous materials. In addition, since the luminous tube is rarely deteriorated, it became possible to extend the life of a metal halide lamp. As a result, color rendering properties of the ceramic metal halide lamp could be improved and improvement of quality of light such as to stabilize a light color and an optical output could be realized and therefore the ceramic metal halide lamps were rapidly permeated into the market so as to illuminate the stores which need high color rendering properties.

However, in the ceramic metal halide lamp, lamp efficiency and color rendering properties are placed in a trade-off relationship and it has been said that it is difficult to improve both of the lamp efficiency and the color rendering properties at the same time. Accordingly, although prior-art ceramic metal halide lamps are famous for high color rendering properties and high lamp efficiency, they are inevitably classified into either ceramic metal halide lamps of the type that emphasizes on the lamp efficiency or ceramic metal halide lamps of the type that emphasizes on the color rendering properties. In general, "lamp efficiency" is expressed by lm/W (lumen per watt: brightness per watt) and "color rendering property" (the property of light source that affects color appearance of objects) is expressed by a general color rendering index (index indicative of color appearance) Ra. In this case, it has been customary that if the lamp efficiency is set to approximately $\eta \geq 100$, then a ceramic metal halide lamp is evaluated as being of the type which emphasizes on the lamp efficiency and that if the general color rendering index is set to approximately $Ra \geq 80$, then a ceramic metal halide lamp is evaluated as being of the type which emphasizes on the color rendering property.

It should be noted that the inventor of the present invention is not aware of the existence of a patent literature and a non-patent literature which may disclose a technology that can realize a ceramic metal halide lamp with high lamp efficiency and high color rendering properties by additionally sealing silver iodide (AgI) into a luminous tube which will be disclosed in the document of the present application.

SUMMARY OF INVENTION

The general color rendering index Ra that is used to evaluate the color rendering properties is a mean value of values evaluated for eight reference colors Nos. 1 to 8 and special color rendering indexes Nos. 9 to 15 are prescribed in order to specify the color rendering properties more in detail. It has been customary that the HID lamp is inferior to other lamps in color appearance of No. 9 (red) (special color rendering index R9) as compared with color rendering properties of other primary colors.

Therefore, one aspect of the present invention relates to a ceramic metal halide lamp including a luminous tube in the interior of an outer bulb, said ceramic metal halide lamp is characterized in that: said luminous tube is made from translucent ceramics and is formed of a light-emitting portion into which metal halides, mercury and a starting gas are sealed and capillaries with a pair of electrode assemblies extended thereto disposed at both ends of said light-emitting portion; said light-emitting portion has sealed therein at least halides of rare earth metal, halide of thallium (Tl), halide of sodium (Na) and halide of calcium (Ca); and said light-emitting portion has further sealed therein halide of silver (Ag); wherein a quantity of silver sealed into said light-emitting portion falls within a range of $2 \leq (Ag/Ca)$[molar ratio]$\leq 5$ and within a range of $0 < (Ag/Tl)$[molar ratio]$\leq 10$.

Further, in the above ceramic metal halide lamp, said rare earth metal may be of either one kind selected from thulium (Tm), dysprosium (Dy), holmium (Ho) and cerium (Ce) or a mixture of more than two kinds selected therefrom.

Further, other aspect of the present invention relates to a ceramic metal halide lamp including a luminous tube in the interior of an outer bulb, said ceramic metal halide lamp is characterized in that: said luminous tube is made from translucent ceramics and is formed of a light-emitting portion into which metal halides, mercury and a starting gas are sealed and capillaries with a pair of electrode assemblies extended thereto disposed at both ends of said light-emitting portion; said light-emitting portion has sealed therein at least thulium iodide ($TmI_3$); thallium iodide (TlI), sodium iodide (NaI) and calcium iodide ($CaI_2$); and said light-emitting portion has further sealed therein silver iodide (AgI); wherein a quantity of said silver iodide sealed into said light-emitting portion falls within a range of $2 \leq (AgI/CaI_2)$[molar ratio]$\leq 5$ and within a range of $0 < (AgI/TlI)$[molar ratio]$\leq 10$.

Further, other aspect of the present invention relates to a ceramic metal halide lamp including a luminous tube in the interior of an outer bulb, said ceramic metal halide is characterized in that: said luminous tube is made from translucent ceramics and being formed of a light-emitting portion into which metal halides, mercury and a starting gas are sealed and capillaries with a pair of electrode assemblies extended thereto disposed at both ends of said light-emitting portion; said light-emitting portion has sealed therein at least thulium iodide ($TmI_3$), thallium iodide (TlI), sodium iodide (NaI) and calcium iodide ($CaI_2$); and said light-emitting portion has further sealed therein silver bromide (AgBr); wherein a quantity of said silver bromide sealed into said light-emitting portion falls within a range of $2 \leq (AgBr/CaI_2)$[molar ratio]$\leq 5$ and within a range of $0 < (AgBr/TlI)$[molar ratio]$\leq 10$.

Furthermore, in the above ceramic metal halide lamp further may include a luminous tube protective sleeve which surrounds the circumference of said luminous tube.

According to one or more embodiments of the present invention, it is possible to provide a ceramic metal halide lamp in which the color rendering property, especially the special color rendering index R9, can be improved while a lowering of lamp efficiency can be suppressed within a permissible range.

DESCRIPTION OF THE PREFERRED EMBODIMENTS

Figure 1B:
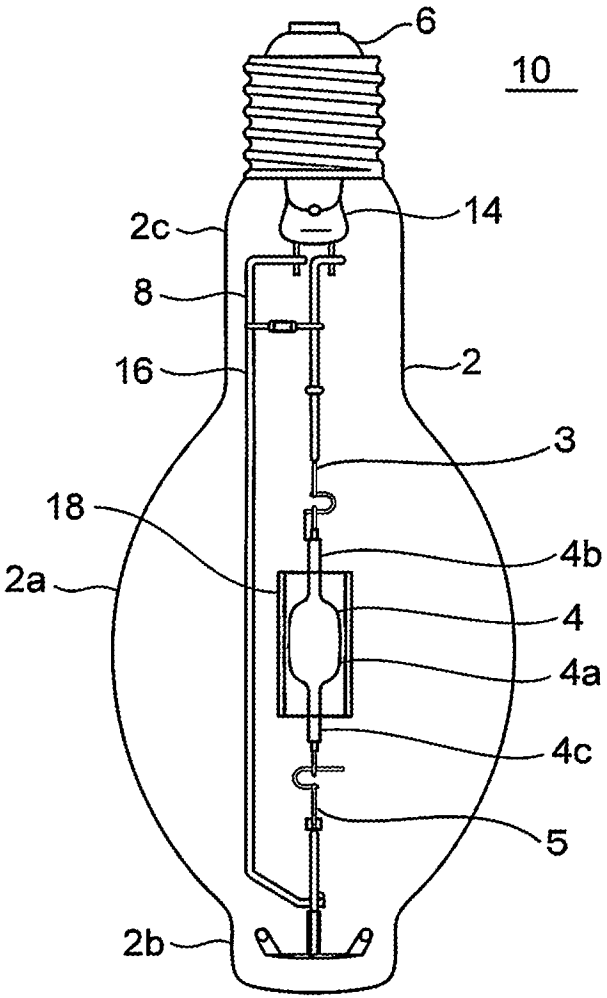
FIGS. 1A-B are diagrams used to explain a structure of a ceramic metal halide lamp.

A ceramic metal halide lamp according to the embodiments of the present invention will hereinafter be described in detail with reference to the accompanying drawings. It should be noted that identical elements are denoted by identical reference numerals in the sheets of drawings and that they will not be described repeatedly.

[Ceramic Metal Halide Lamp]

Figure 1A:
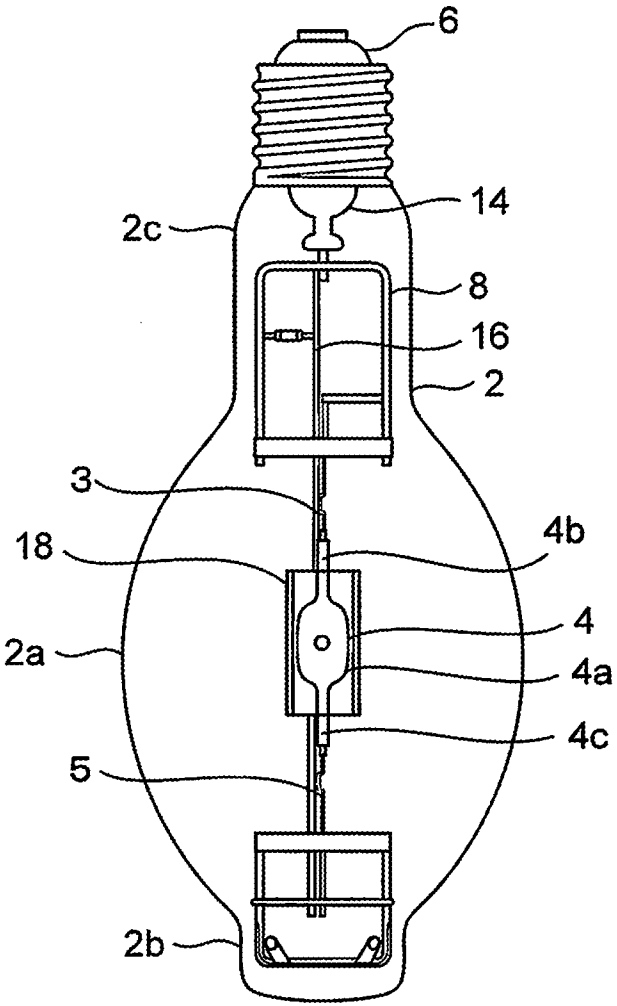

FIG. 1 is a diagram useful for explaining a structure of a ceramic metal halide lamp. FIG. 1A is a front view of a lamp and FIG. 1B is a side view thereof. A lamp 10 includes a luminous tube (arc tube) 4 which serves as a light-emitting portion sealed into the inside of an outer bulb 2. The circumference of the luminous tube is surrounded by a luminous tube protective sleeve (referred to also as an "inner tube") 18. An E-type base 6 is bonded to the end portion of the outer bulb 2. The luminous tube 4 is supported to the lamp at its predetermined position by a mount 8 of a structure composed of assemblies of metal wires and plates and to which the inner tube 18 is attached, and the luminous tube is thereby energized. It should be noted that two sets of the combination of luminous tube and inner tube may be disposed in the inside of the outer bulb 2.

These respective elements will be explained in brief.

The luminous tube 4 is a translucent ceramic vessel shaped so as to have a central light-emitting portion (thick tube portion) 4*a* and capillaries (thin tube portions) 4*b*, 4*c* connected to respective ends of the central light-emitting portion. A pair of lead wires 3, 5 is extended through these thin tube portions 4*b*, 4*c* to the area of the light-emitting portion 4*a*, whereby a pair of main electrodes made of tungsten (W) is formed. It should be noted that characteristics of this luminous tube 4 and luminous materials sealed into this luminous tube will be described in detail later on.

The mount 18 is mainly comprised of a stem tube 14 into which a pair of lead-in wires is sealed in an air-tight fashion and a support 16 connected to one of the lead-in wires and which is formed of a wire material such as a nickel-plated iron wire and a round-bar body shaped as a frame of substantially a rectangular shape.

The inner tubes 18 is disposed so as to surround the circumference of the luminous tube 4 in order to protect the outer bulb from being affected by the luminous tube 4 in the event of rupture of the luminous tube and it is made of a transparent quartz glass tube. Since the inner tube is disposed around the luminous tube 4, there can be achieved the effect in which the luminous tube is kept warm during the luminous tube is being energized to produce light. Therefore, since a value of a wall loading (electric power of lamp/inner area of light-emitting portion) of the light-emitting portion can be decreased as compared with that of a lamp which does not include an inner tube, a probability that the luminous tube will be ruptured can be decreased. Further, in a luminous tube of which wall loading is comparatively small, it is possible to suppress a velocity at which a luminous tube and luminous materials sealed into the luminous tube react with each other chemically. However, the existence of the inner tube 18 is not indispensable to the lamp 10 and the inner tube may be removed.

The outer bulb 2 is made of translucent hard glass such as borosilicate glass, for example. The translucent hard glass may be either transparent type hard glass or diffusion type (opaque type) hard glass. The outer bulb 2 is shaped as a BT type having a central portion 2*a* with a maximum diameter, a closed top portion 2*b* as seen from the lower portion side of the sheet of drawing and a neck portion 2*c* as seen from the upper portion side of the sheet of drawing. The neck portion 2*c* includes a seal portion into which there is sealed a flared portion of the stem tube 14. After the flared portion of the stem tube was sealed into the seal portion of the neck portion, the outer bulb 2 is evacuated through an exhaust pipe (not shown) provided at the stem tube 14 and is then sealed by an inert gas such as an argon (Ar) gas and a nitrogen (N2) gas or it is kept vacuum in the air-tight atmosphere.

The screw-type base 6 is joined to the outer bulb so as to cover this sealed portion by using a heat-resistant adhesive or screwing the base 6 into a spiral-shaped screw thread groove formed by molding, and it is thereby attached to the outer bulb. The lamp 10 is energized through a predetermined lighting circuit apparatus by screwing the base 6 into a socket (not shown) and lighting of the lamp is thereby maintained stably by discharges occurred between the main electrodes.

[Luminous Materials]

The inventor of the present invention has made studies to improve the color rendering property, especially the special color rendering index R9, by using such lamp. The lamp used in the studies can offer a rated output of 100 W and a correlated color temperature of 4200K.

Metal halide, mercury and a starting rare gas are sealed into the light-emitting portion of the luminous tube of this type as luminous materials. Halide may contain at least halide of rare earth metals, halide of thallium, halide of sodium (Na) and halide of calcium (Ca). Rare earth metals may contain mixtures of one or more kinds of thulium (Tm), dysprosium (Dy), holmium (Ho) and cerium (Ce).

A table 1 shows luminous materials sealed into the light-emitting portions of the lamps that had been used in the experiments. A sample No. 1 shows an existing lamp which is demonstrated as a comparative example relative to lamps Nos. 2 and 3 disclosed in the embodiments of the present invention.

TABLE 1

| Luminous materials sealed into the light-emitting portions | | | | | | | |
|---|---|---|---|---|---|---|---|
| Sample No. | $CeI_3$ [$\times 10^{-3}$ mol/cc] | $DyI_3$ [$\times 10^{-3}$ mol/cc] | $TmI_3$ [$\times 10^{-3}$ mol/cc] | TlI [$\times 10^{-3}$ mol/cc] | NaI [$\times 10^{-3}$ mol/cc] | $CaI_2$ [$\times 10^{-3}$ mol/cc] | AgI [$\times 10^{-3}$ mol/cc] |
| 1 (existing) | 0.08 | 0.24 | 0.65 | 0.10 | 0.11 | 0.17 | zero |
| 2 | | | | | | | 0.35 |
| 3 | | | | | | | 0.70 |

Into the lamp of the sample No. 1, there are sealed thulium iodide ($TmI_3$), thallium iodide (TlI), sodium iodide (NaI) and calcium iodide ($CaI_2$) as metal halides. Further, into the lamp of this sample, there are sealed dysprosium iodide ($DyI_3$) and cerium iodide ($CeI_3$).

In a Tm-TI-Na-based ceramic metal halide lamp into which there are sealed thulium iodide ($TmI_3$), thallium iodide (TlI) and sodium iodide (NaI) of the metal halides, the thulium iodide ($TmI_3$) can increase emission of light in the green region, the thallium iodide (TlI) can improve luminous efficiency and the sodium iodide (NaI) can increase emission of light in the yellow region to thereby improve color rendering properties.

Further, calcium iodide ($CaI_2$) is sealed into the lamp of this sample as a luminous material. The calcium iodide ($CaI_2$) is used in order to reduce the change of colors and to suppress fluctuations of arc. At the same time, the calcium iodide ($CaI_2$) can achieve the effects to increase emission of light in the red region to thereby improve the color rendering properties. However, if the quantity of the calcium iodide ($CaI_2$) is increased simply, for example, the quantity of the calcium iodide is increased so as to become more than 50 mol % of the whole of the halides, then light emission of other luminous materials will be lowered, giving rise to a lowering of the lamp efficiency $\eta$. Also, in order to avoid the lamp efficiency $\eta$ from being lowered, if the quantity of the calcium iodide ($CaI_2$) sealed into the lamp is decreased so as to become, for example, less than 20% of the whole of the halides, the increase of emission of light in the red region cannot be expected.

The inventor of the present invention has discovered the fact that if silver iodide (AgI) is additionally sealed into the existing lamp (sample No. 1), then the emission of light in the red region is increased without increasing the quantity of the calcium iodide ($CaI_2$). As the reasons why the silver iodide (AgI) is employed, there can be enumerated the following reasons in which the silver iodide does not have a strong peak in the visible light region fundamentally so that it may not impose a large influence upon the optical characteristics of the lamp. Further, since the silver iodide rarely reacts with polycrystalline alumina which forms the luminous tube 4, there is no risk that the luminous tube will be eroded by the silver iodide.

TABLE 2

| Data obtained from samples shown in TABLE 1 | | | | | | |
|---|---|---|---|---|---|---|
| Sample No. | Luminous flux [lm] | Tcp [k] | Ra | R9 | $AgI/CaI_2$ [molar ratio] | AgI/TlI [molar ratio] |
| 1 (existing) | 11100 | 4130 | 93 | 45 | zero | zero |
| 2 | 10800 | 4100 | | 54 | 3.1 | 7.1 |
| 3 | 10200 | 3920 | | 50 | 6.3 | 14.1 |

Figure 2A:
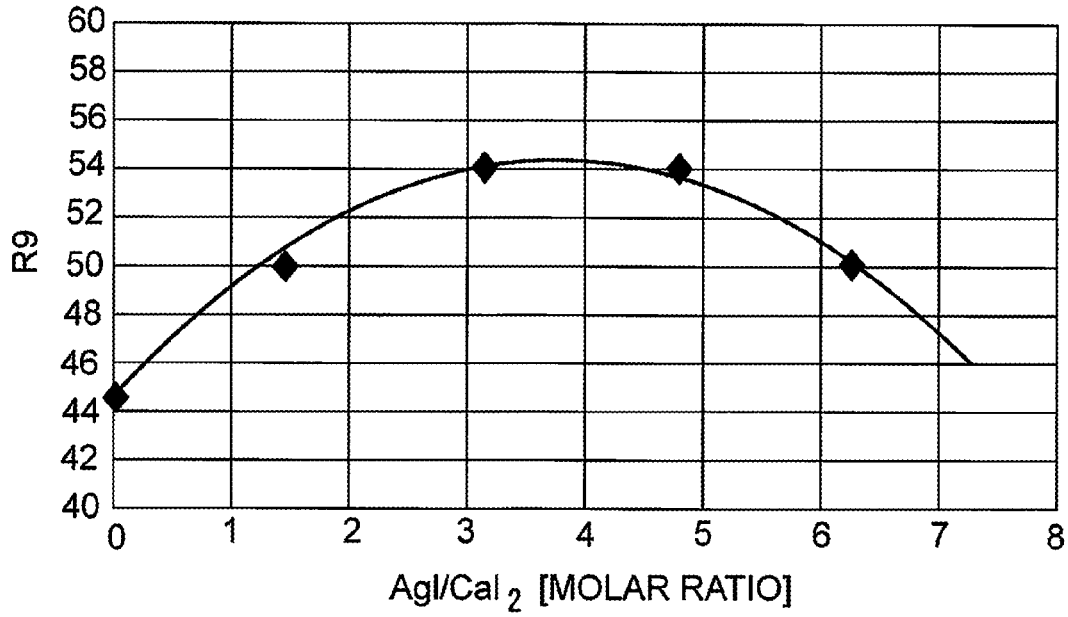
FIG. 2A is a graph obtained when the horizontal axis represents ($AgI/CaI_2$)[molar ratio] and the vertical axis represents a special color rendering index R9.

FIG. 2A is a graph obtained when the horizontal axis represents ($AgI/CaI_2$)[molar ratio] and the vertical axis represents the special color rendering index R9.

A study of data concerning the samples Nos. 1 to 3 may reveal that if the ratio [molar ratio] of the silver iodide (AgI) relative to the calcium iodide ($CaI_2$) is increased from zero to 6.3, then the special color rendering index R9 is raised from 45 to 54 and then it is lowered to 50. If R9≥50 which is higher than the special color rendering index R9=45 of the existing lamp (sample No. 1) by +10% is selected to be a desirable special color rendering index of the red-based colors, then the above ratio may fall within a range of $2 \leq (AgI/CaI_2)$[molar ratio]$\leq 5$. In other words, based on the quantity of the calcium iodide ($CaI_2$) sealed into the existing lamp, the quantity of the silver iodide (AgI) sealed into the lamp may fall within a range of $2 \times CaI_2 \leq (AgI) \leq 5 \times CaI_2$ (unit is mole).

With respect to anxiety of a lowering of light emission of other luminous materials, the light emission is not affected by additionally sealing the silver iodide (AgI) into the lamp. As shown on the TABLE 2, with respect to the samples Nos. 1 to 3, the general color rendering index is made constant as Ra=93 and it is not changed.

Further, thallium iodide (TlI) is sealed into the existing lamp (sample No. 1) as a luminous material. The thallium iodide (TlI) is a material which can produce light with a wavelength of 535 nm which has high relative luminous efficiency. The thallium iodide can impose the largest influence upon a luminous flux value.

Figure 2B:
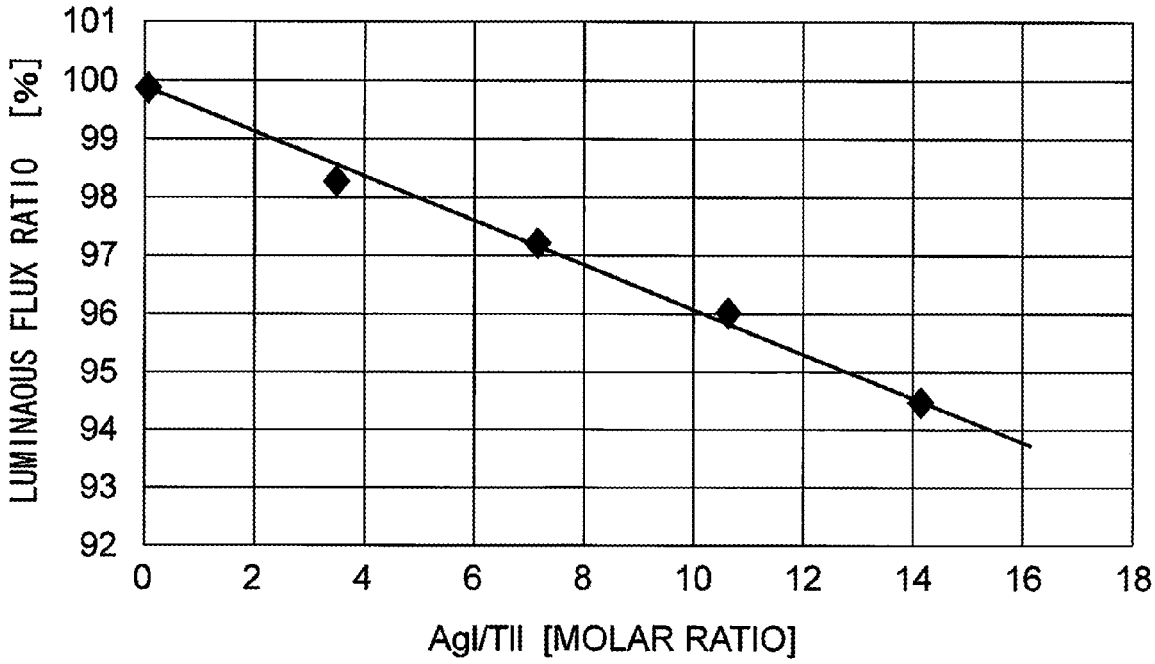
FIG. 2B is a graph obtained when the horizontal axis represents (AgI/TlI)[molar ratio] and the vertical axis represents a luminous flux ratio [%].

There was a risk that the lamp efficiency $\eta$ will be lowered if color rendering properties are improved by additionally sealing the silver iodide (AgI) into the lamp. Therefore, we have made experiments to study a relationship of the rate between the silver iodide (AgI) additionally sealed, this time, into the lamp relative to the thallium iodide (TlI), which is a most influential material to a luminous flux value, and lamp efficiency. FIG. 2B is a graph obtained when the horizontal axis represents (AgI/TlI)[molar ratio] and the vertical axis represents a luminous flux ratio. The luminous flux ratio expresses ratios of luminous flux values of respective lamps obtained when a luminous flux value 11100 [lm] of the existing lamp (sample No. 1) is set to be 100%.

Since the ratio [molar ratio] of the silver iodide (AgI) relative to the thallium iodide (TlI) is increased from zero to 14, the luminous flux ratio is lowered to 94.4%. Here, if the change of the luminous flux value falls within a range of ±5%, then the change of the luminous flux value does not cause an uncomfortable feeling to human eyes and therefore no trouble occurs in actual use. It should be noted that a change of −5% in the lamp efficiency $\eta$=111 [lm/W] of the existing lamp (sample No. 1) with a rated output 100 W and the luminous flux value 111,000 [lm] is equivalent to lamp efficiency $\eta$=105 [lm/W].

If a lowering of luminous flux value is suppressed to be less than 5%, then the above ratio falls within a range of 0<(AgI/TlI)[molar ratio]<10. In other words, based on the quantity of the thallium iodide (TlI) sealed into the existing lamp, the quantity of the silver iodide (AgI) sealed into the lamp may fall within a range of $0<(AgI)<10\times TlI$[unit is mole].

Figure 3:
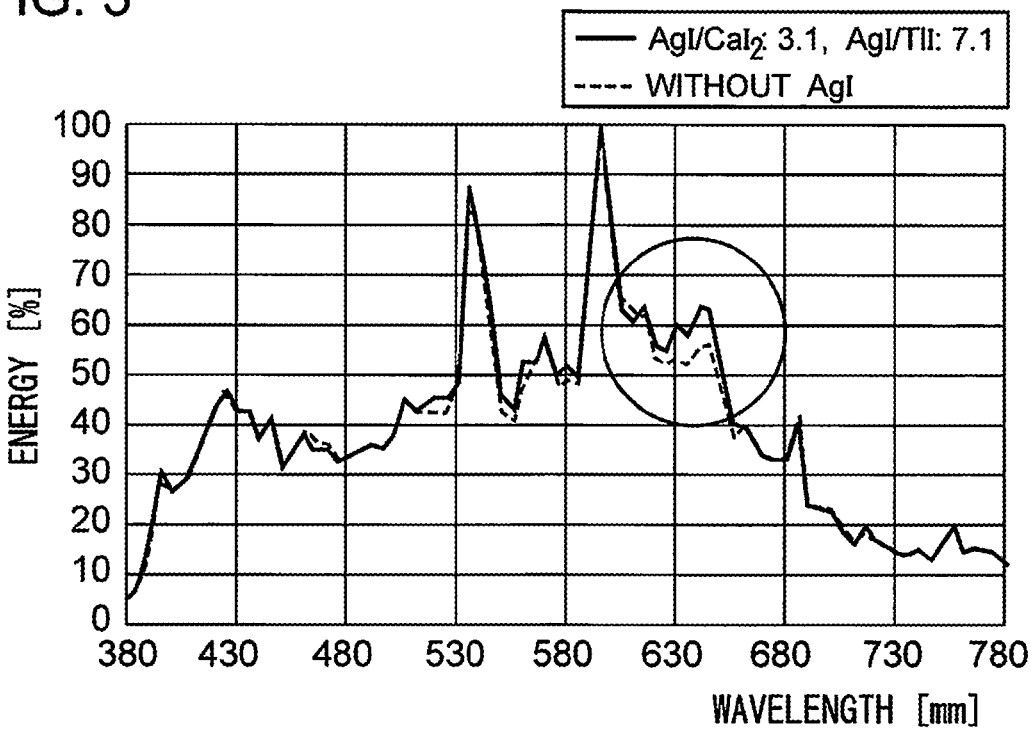
FIG. 3 is a spectral distribution diagram (shown by a solid line) of a typical lamp obtained when a small quantity of calcium iodide is added to a lamp as a luminous metal and in which silver iodide (AgI) is additionally used together with calcium iodide. As a comparative example, there is also shown a spectral distribution diagram (shown by a broken line) of a lamp in which silver iodide (AgI) is not added to the lamp.

FIG. 3 is a spectral distribution diagram (shown by a solid line) of a typical lamp obtained when silver iodide (AgI) is additionally used in addition to a small quantity of calcium iodide as a luminous metal. As a comparative example, there is also shown a spectral distribution diagram (shown by a broken line) obtained when the silver iodide is not added to the lamp. Here, the lamps obtained when the silver iodide (AgI) is used additionally are those lamps with ($AgI/CaI_2$)[molar ratio]=3.1 and (AgI/TlI)[molar ratio]=7.1 which can respectively satisfy the above-mentioned conditions, $2\leq(AgI/CaI_2)$[molar ratio]$\leq5$ and $0<(AgI/TlI)$[molar ratio]$\leq10$.

The spectral distribution diagram will be further described with reference to the portion shown by an open circle in FIG. 3. As it is clear from the spectral distribution diagram of FIG. 3, luminous intensity in the red region is not increased only by adding the calcium iodide. However, if the silver iodide is additionally used together with the calcium iodide, then it is possible to realize lamps in which luminous intensities in the regions with wavelengths ranging of from 630 to 650 nm can be increased but luminous intensities in the regions with other wavelengths can be prevented from being lowered even when the quantity of the calcium iodide sealed into the lamp is the same.

[Alternative]

(1) While the example in which the silver, which is the metal halide, was sealed into the light-emitting portion of the lamp in the form of iodide has been described so far in the embodiments of the present invention, the present invention is not limited thereto and the silver iodide can be replaced with silver bromide (AgBr) which is bromide. Since the silver bromide (AgBr) has properties similar to those of the silver iodide (AgI) from a standpoint in which they are easy to be electrolytically dissociated and ionized, a part of or whole of the silver iodide (AgI) can be replaced with the silver bromide (AgBr). When the silver bromide (AgBr) is additionally used together with the calcium iodide and the thallium iodide, the quantities of the silver bromide, the calcium iodide and the thallium iodide are calculated by the following equations.

$$2\leq(AgBr/CaI_2)[\text{molar ratio}]\leq5$$

$$0<(AgBr/TlI)[\text{molar ratio}]\leq10$$

(2) While the examples in which the luminous metals were sealed into the light-emitting portion of the lamp as the iodides have been described so far, the present invention is not limited thereto and the iodides can be replaced with other halides. In the metal halide lamp, a very high pulse voltage (for example, 3.7 to 4.5 kV) is instantaneously applied to the electrodes of the luminous tube from a ballast (not shown) in the state in which it is superimposed upon a base voltage (for example, 200 to 300V) to cause a breakdown so that the metal halide lamp is moved to glow discharge state. Further, when the metal halide lamp is moved to the arc discharge state, the metal halide lamp is being used. During the metal halide lamp is being energized to produce light, almost all of the metal halides are placed in the electrolytically dissociated state so that such metals can function as luminous materials. Accordingly, the metal halide lamp disclosed in the embodiments of the present invention can be presented as follows.

At least halide of rare earth metal, halide of thallium, halide of sodium (Na) and halide of calcium (Ca) are sealed into the light-emitting portion. Further, halides of silver (Ag) are sealed into the light-emitting portion and the quantities of the halides of the silver are expressed as follows.

$$2\leq(Ag/Ca)[\text{molar ratio}]\leq5$$

$$0<(Ag/Tl)[\text{molar ratio}]\leq10$$

(3) Of the luminous metals, thulium (Tm) can be replaced with other rare earth metals. Especially, of the rare earth metals, thulium (Tm), dysprosium (Dy), holmium (Ho) and cerium (Ce) can be replaced with each other or more than two kinds of them can be sealed into the light-emitting portion as mixtures with substantially equal effects being achieved.

[Luminous Tube]

Figure 4:
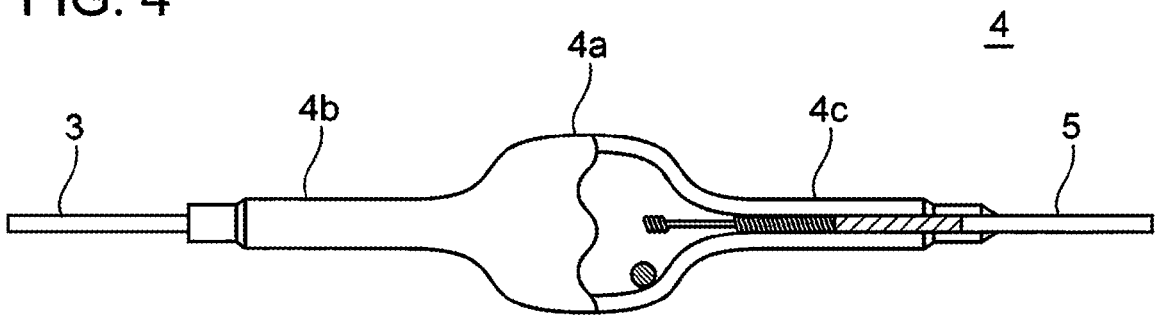
FIG. 4 is a diagram showing in a partly cross-sectional fashion a luminous tube used in the embodiments of the present invention.

FIG. 4 is a diagram showing in a partly cross-sectional fashion the luminous tube 4 used in the embodiments of the present invention. This luminous tube 4 includes a light-emitting portion 4*a* of a substantially elliptical shape formed when it is rotated around its major axis and a pair of capillaries 4*b*, 4*c* continuously formed at respective ends of the major axis of that ellipse through a transition curved surface without corner portions. The luminous tube 4 is of what might be called one-piece type luminous tube in which the light-emitting portion 4*a* and capillaries 4*b*, 4*c* are formed by integrally molding translucent alumina powder compressed bodies. Therefore, the thickness of the luminous tube can be made uniform. It should be noted that the luminous tube may be formed as what might be called two-piece type luminous tube in which the light-emitting portion 4 and the capillaries 4*a*, 4*b* are respectively molded as half light-emitting portions and half capillaries, whereafter they may be joined together at the central portion of the light-emitting portion.

For example, in a luminous tube of a type in which a light-emitting portion and capillaries are separately manufactured as independent parts (three pieces or five pieces) and assembled by shrinkage when ceramics are sintered, the thickness of the end portions of the light-emitting portion is made 1.5 times thicker than that of the central portion in order to maintain a mechanical strength required when the luminous tube is assembled by shrinkage. The end portion of the luminous tube is made distant from the place in which discharges may occur in the light-emitting portion and it is thick so that a temperature is difficult to rise in the end portion of the luminous tube. In order to increase a temperature in the coldest portion, the wall loading has to be set higher so that a temperature difference becomes large within the light-emitting portion. When the wall loading is high, since a maximum temperature in the light-emitting portion becomes very high, the luminous tube is caused to react with the metal halides violently at the portion in which the maximum temperature is very high and hence the luminous tube is eroded quickly, thereby reducing a life span of the lamp.

On the other hand, in the luminous tube 4 for use with the embodiments of the present invention, since the thickness of the luminous tube is made uniform, the wall loading can be reduced. Therefore, without sacrificing the lamp life, it is possible to realize high lamp efficiency and high color rendering properties.

Advantages and Effects of Embodiments

Since such luminous tube was used and the silver iodide (AgI) of the predetermined quantity was sealed into the light-emitting portion of the lamp, the improvement of the color rendering properties can be realized while a lowering of the lamp efficiency can be suppressed within a permissible range. To be concrete, according to the embodiments of the present invention, in the lamp of 100 W class, there can be provided a metal halide lamp having high color rendering properties of the special color rendering index $R9\geq50$ and the general color rendering index $Ra>90$ and which can meet the requirements of high efficiency such as lamp efficiency $\eta>100$. As long as the luminous tubes are identical to each other in fundamental structure, when the compositions of the luminous materials within the light-emitting portion are determined in terms of the molar ratio, ceramic metal halide lamps of other outputs than the 100 W class can obtain similar results.

As a result, it is possible to realize a ceramic metal halide lamp with high lamp efficiency and high color rendering properties.

While the ceramic metal halide lamps including the outer bulb protective structure according to the embodiments of the present invention have been explained so far, those ceramic metal halide lamps were described by way of example and may not limit the scope of the present invention. Addition, deletion, alteration, improvement and so on which can be made easily by those skilled in the art may fall within the scope of the present invention. The scope of the present invention may be determined by the descriptions of the attached claims.

REFERENCE SIGNS LIST

2: outer bulb, 2*a*: central portion, 2*b*: top portion, 2*c*: neck portion, 3: lead wire, 4: luminous tube, 4*a*: light-emitting portion, thick tube portion, 4*b*,4*c*: capillaries, thin tube portions, 5: lead wire, 6: base, 8: mount, 10: lamp, 14: stem tube, 16: support, 18: inner tube, luminous tube protective sleeve

What is claimed is:

1. In a ceramic metal halide lamp including a luminous tube in the interior of an outer bulb, said ceramic metal halide lamp is characterized in that:

said luminous tube is made from translucent ceramics and is formed of a light-emitting portion into which metal halides, mercury and a starting gas are sealed and capillaries with a pair of electrode assemblies extended thereto disposed at both ends of said light-emitting portion;

said light-emitting portion has sealed therein at least halides of rare earth metal, halide of thallium (Tl), halide of sodium (Na) and halide of calcium (Ca); and said light-emitting portion has further sealed therein halide of silver (Ag);

wherein a quantity of silver sealed into said light-emitting portion falls within a range of $2 \leq (Ag/Ca)$[molar ratio]$\leq 5$ and within a range of $0 < (Ag/Tl)$[molar ratio]$\leq 10$.

2. In a ceramic metal halide lamp according to claim 1:

said rare earth metal is of either one kind selected from thulium (Tm), dysprosium (Dy), holmium (Ho) and cerium (Ce) or a mixture of more than two kinds selected therefrom.

3. In a ceramic metal halide lamp including a luminous tube in the interior of an outer bulb, said ceramic metal halide lamp is characterized in that:

said luminous tube is made from translucent ceramics and is formed of a light-emitting portion into which metal halides, mercury and a starting gas are sealed and capillaries with a pair of electrode assemblies extended thereto disposed at both ends of said light-emitting portion;

said light-emitting portion has sealed therein at least thulium iodide ($TmI_3$);

thallium iodide (TlI), sodium iodide (NaI) and calcium iodide ($CaI_2$); and said light-emitting portion has further sealed therein silver iodide (AgI);

wherein a quantity of said silver iodide sealed into said light-emitting portion falls within a range of $2 \leq (AgI/CaI_2)$[molar ratio]$\leq 5$ and within a range of $0 < (AgI/TlI)$[molar ratio]$\leq 10$.

4. In a ceramic metal halide lamp including a luminous tube in the interior of an outer bulb, said ceramic metal halide is characterized in that:

said luminous tube is made from translucent ceramics and being formed of a light-emitting portion into which metal halides, mercury and a starting gas are sealed and capillaries with a pair of electrode assemblies extended thereto disposed at both ends of said light-emitting portion;

said light-emitting portion has sealed therein at least thulium iodide ($TmI_3$), thallium iodide (TlI), sodium iodide (NaI) and calcium iodide ($CaI_2$); and said light-emitting portion has further sealed therein silver bromide (AgBr);

wherein a quantity of said silver bromide sealed into said light-emitting portion falls within a range of $2 \leq (AgBr/CaI_2)$[molar ratio]$\leq 5$ and within a range of $0 < (AgBr/TlI)$[molar ratio]$\leq 10$.

5. In a ceramic metal halide lamp according to claim 1, said ceramic metal halide lamp further includes a luminous tube protective sleeve which surrounds the circumference of said luminous tube.

6. In a ceramic metal halide lamp according to claim 2, said ceramic metal halide lamp further includes a luminous tube protective sleeve which surrounds the circumference of said luminous tube.

7. In a ceramic metal halide lamp according to claim 3, said ceramic metal halide lamp further includes a luminous tube protective sleeve which surrounds the circumference of said luminous tube.

8. In a ceramic metal halide lamp according to claim 4, said ceramic metal halide lamp further includes a luminous tube protective sleeve which surrounds the circumference of said luminous tube.

* * * * *